United States Patent [19]

Christian

[11] 4,243,393

[45] Jan. 6, 1981

[54] COAL ARTICLE

[75] Inventor: Miles W. Christian, Plymouth, Ohio

[73] Assignee: Banner Energy Corporation, Plymouth, Ohio

[21] Appl. No.: 841,937

[22] Filed: Oct. 13, 1977

[51] Int. Cl.[3] ..... C10L 5/36

[52] U.S. Cl. ..... 44/14; 44/38

[58] Field of Search ..... 44/10 R, 14, 41, 15 C, 44/38

[56] References Cited

U.S. PATENT DOCUMENTS

| | | | |
|---|---|---|---|
| 57,890 | 9/1866 | Gilson | 44/14 |
| 1,194,613 | 8/1916 | Fredrikson | 44/14 |
| 1,780,205 | 11/1930 | Maurel | 44/14 |
| 2,107,054 | 2/1938 | Haymond | 44/41 |
| 2,618,537 | 11/1952 | Rabu | 44/10 R |
| 3,726,651 | 4/1973 | Ronden | 44/14 |
| 3,989,433 | 11/1976 | Furman | 425/149 |
| 4,049,390 | 9/1977 | Furman | 44/10 R |
| 4,060,396 | 11/1977 | Burton | 24/14 |
| 4,062,655 | 12/1977 | Brockbank | 44/10 R |

FOREIGN PATENT DOCUMENTS

| | | | |
|---|---|---|---|
| 506283 | 5/1939 | United Kingdom | 44/15 C |

*Primary Examiner*—Carl F. Dees

*Attorney, Agent, or Firm*—Maky, Renner, Otto & Boisselle

[57] ABSTRACT

Coal is restructured by extrusion into a tube like article that has a hollow core, which may contain igniter material to facilitate ignition of the coal. The hollow core and possibly other deformities, such as ribs, flutes or the like in the inner or outer walls of the tube-like article and/or slotted, circular or like openings through the tube wall artifically create an environment that enhances the burning characteristics in a relatively open or uncontrolled environment that is ordinarily hostile to the burning of coal. The article may be burned according to a novel process that creates coke.

12 Claims, 8 Drawing Figures

COAL ARTICLE

BACKGROUND OF THE INVENTION

The present invention relates to restructured coal and, more particularly, to a tube-like coal article. Moreover, the invention relates to a method of burning coal without consuming the free carbon thereof.

Chunks of coal may be satisfactorily burned in controlled, relatively closed environments, e.g. in a furnace, boiler, stove, etc. Usually there is sufficient air, for example provided by a forced or other artificial draft, to assure substantially complete combustion of the coal; and as long as there is sufficient combustion, temperature and air, additional coal introduced to such controlled environment also will burn. To facilitate such burning in some cases the coal is pulverized to relatively small particulate form before or as it is delivered to the combustion area. The residue of such substantially complete combustion is ash, which usually is not valuable for further energy-related purposes and often is difficult and messy to dispose.

In the past relatively controlled and complete burning of coal in relatively open environments, e.g. in a home fireplace, a campfire, or the like, has met with unsatisfactory results. Moreover, the sparks and fly ash, which are produced when coal is ordinarily burned, are further disadvantages that would be encountered when trying to burn coal in such open environments.

When coal is mined to obtain the usual chunk-like pieces of coal, coal fines, which are relatively particle-like or powder-like, also usually are produced. However, such coal fines customarily have been considered a nuisance due to the difficulty of storing and transporting the same, for example, and frequently such fines have been discarded.

In the past, efforts were made to burn solid log-like coal articles. These efforts, however, had unsatisfactory results unless the coal log were burned in the aforementioned controlled environments. To burn such a solid coal log in an open environment, such as a fireplace or a campfire, has been found very difficult and sometimes impossible.

Coke, which is mostly pure carbon, is a useful product derived from coal. One well known important use of coke is in the making of steel. To make coke itself, coal is delivered into a coking or by-product oven or a beehive where the coal is heated in a relatively low oxygen or oxygen-free environment without any substantial combustion of the coal. In the oven or beehive gas, referred to as coal gas, producer gas, water gas, and the like, which includes substantial amounts of combustible methane, and other by-products are emitted by the coal, leaving at the end of the process, as is well known, coke of relatively pure carbon composition. In some coking processes the gas may be recovered and burned as a supplemental fuel to provide heat for continuing the coking process.

SUMMARY OF THE INVENTION

A primary object of the invention is to enable the combustion of coal in a relatively uncontrolled or hostile environment.

Another object is to use productively previously wasted coal fines or the like.

An additional object is to reduce the ash residue, fly ash, and/or sparks produced during combustion of coal.

A further object is to create coke in a relatively uncontrolled environment.

Still another object is to provide a novel method for burning coal.

Still an additional object is to facilitate the control of burning parameters, such as time and rate of burning, of coal.

Still a further object is to create a unique stack effect in a coal article to facilitate burning a tube-like restructured coal article without a substantial supplemental supportive air source, such as a forced draft.

These and other objects and advantages are achieved in the present invention which comprises a restructured coal article in the form of a hollow tube-like structure or article and a method of burning the same conveniently in a relatively uncontrolled environment.

In accordance with one aspect of the invention the tube-like article is generally cylindrical in shape, of compressed or bound coal, for example, formed by extrusion, with such cylinder having a hollow core. Means, such as slots, ribs, flutes, openings, and the like may be provided to increase the exposure of surface area for increased gas emission from the coal and oxygen supply proximity. Such article may be burned, i.e. the gases, free carbon and other ingredients may burn, while positioned in various orientations, for example, in a fireplace, campfire or the like. When vertically oriented the tube-like article creates its own stack effect to facilitate burning.

However, in accordance with another aspect of the invention such tube-like article is placed vertically on a flat solid surface with the axis of the core generally perpendicular to such surface to impede admittance of air into the core from the bottom of the structure. The article is heated at its inner wall surface directly bounding the core, for example by a conventional torch or a conventional rapid burning igniter material partly or completely filling the core. Such heating causes the coal proximate the core to rise in temperature and, therefore, to emit such gas, which burns mostly proximate the top end of the structure where there is sufficient air to support combustion to produce a candle-like flame. Since the core is relatively oxygen starved, minimal or no burning will occur in the core. However, the heat produced by the burning gas will be sufficient to continue the emission of gas by the coal to continue such flame.

Following the latter method, when the constituents forming the gas in the coal are substantially fully consumed, the flame will extinguish. The major part of the remaining residue, then, will be a tube-like structure of coke, which may be conveniently and cleanly disposed or transferred for subsequent usage.

The invention has utility, for example, in that the article and method of burning the same provide for the generating of heat in uncontrolled environments and, additionally, can enable the production of coke in uncontrolled environments.

DESCRIPTION OF THE PREFERRED EMBODIMENTS

Figure 1:
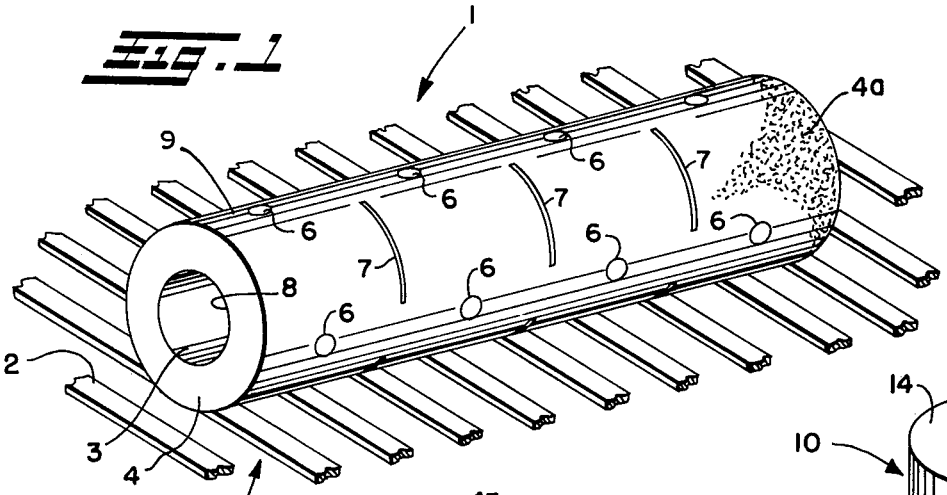
FIG. 1 is an isometric view of a horizontally placed coal article in accordance with the invention.

Referring now to the drawing, a restructured coal article in accordance with the present invention is generally indicated at 1 in FIG. 1. The article 1 is generally elongate, having, for example, an axis 2, and tube-like, having a hollow interior core portion 3 circumscribed by a generally cylindrical or other shape wall 4. For example, the wall 4 may be of rectangular, hexagonal, star shape, etc. cross section. In FIG. 1 the article 1 is positioned on a conventional fireplace grate stand 5 with the axis 2 in horizontal position. The article 1 may have a plurality of holes 6, say of relatively large diameter on the order of about one half inch to about one and one half inches, and/or slots 7, say of narrow width but long length, through the wall 4 communicating between the hollow core 3 and the externally ambient environment.

The article 1 may be formed, for example, by extrusion. Coal fines on the order of, for example, from about 50 mesh to about ¼ inch may be mixed with a binder, such as a water activated binder, a coal byproduct binder, e.g. coal tar, or a petroleum byproduct binder, e.g. asphalt, or the like, possibly including a wetting agent, a lubricant, or other materials conventionally used in extrusion, and the mixture may be extruded to form the tube-like restructured coal article 1. The green ware, i.e. the fresh extrusion output from the extruder, may be cut to size, and the openings 6 or slots 7 may be formed before the green ware finally cures or hardens or afterwards, for example, by drilling, sawing, or the like.

The diameter of the article 1 may be on the order of, for example, about 4 inches and that of the core 3 may be on the order of about 2 inches. However, if desired, other sizes may be employed, depending on the extrusion equipment available, the structural properties of the article, i.e. its strength, which usually varies with the binding strength of the binder, the amount of drying required if a water activated binder is used, the duration of intended burning, etc. The exposure provided by the hollow interior facilitates such water drying or the curing or hardening of other types of binders. The axial length of the article 1 also is variable, although it should be selected to allow placement of the article properly in a grate 5 or other horizontal orientation, as is illustrated in FIG. 1, or, alternatively, to permit vertical orientation placement of the article in the manner illustrated in FIG. 2, for example, while providing sufficient clearance with the top of the fireplace, furnace, or like area in which the article is to be used.

Various types of coal may be used to form the restructured coal article 1. One type of coal known as "cannel" coal is most preferred since it is most easily ignited and burned; however, other types of hard or soft coal, lignite, etc. also may be used. Moreover, although the preferred condition of the coal being used is in a relatively small particulate form, such as coal fines, in order to facilitate extrusion as well as to provide a useful function for previously discarded fines, larger chunks of coal also may be used. In the latter case, the chunks ordinarily would be crushed to the relatively small particulate form of on the order of from about 50 mesh to about ¼ inch in order to enable extrusion thereof to form the article 1.

The binder material, which binds the coal to form the restructured coal article, should be on the order of about 1 to 10 percent and generally will be about 5 percent by weight of the article. The total amount of binder used may vary as long as the quantity is sufficient to bind the particulate coal in the rigid structure and is not too much that it would excessively detrimentally affect or prevent burning of the article. If a water activated binder is used, a wetting agent also may be used to reduce the water surface tension in order to enhance the binder activation and coating of it on the particulate coal. If a coal or petroleum byproduct binder, such as coal tar or asphalt, is used as the binder, such material preferably should have a relatively low sulfur content in order to avoid placing sulfur containing pollutants in the atmosphere.

Other ingredients also may be included in the restructured coal article 1. For example, odorants may be used to provide a desirable odor in the ambient environment when the article is burned. Also, wax-like material may be used to facilitate the ignition and burning of the coal and to maintain the flame produced thereby. In one embodiment the extruded coal article simply may be dipped in a hot wax bath to coat the article, which then is removed from the bath to allow solidification of the wax coating 4*a* and the wax permeating the article. Also, a lubricant may be added when the ingredients to be extruded are mixed or during the extrusion thereof in order to facilitate the flowing of the ingredients through the extruder. The quantities of such additional ingredients may be varied, as desired. Preferably, though, such additional ingredients should be the type that enhance or do not retard excessively the burning characteristics of the coal.

One extruder that may be used to extrude the restructured coal article 1 is sold by Plymouth Locomotive Works, Inc. under the designation Type B Model 7. A conventional mixer may be employed to premix the particulate coal, binder, and/or other ingredients prior to delivery into such extruder, and conventional cutting, stacking, or like equipment may be used for cutting the green ware and/or stacking the same. Also, if desired, a conventional dryer may be used to dry the water from the green ware when a water activated binder is used.

In one example of preferred embodiment of the invention about two thousand pounds of coal fines including about sixty pounds of moisture may be combined with about 38.8 pounds of pre-cooked wheat starch binder, such as that sold by General Mills Company, about two tenths pound of a lubricant, such as CFA ceramic forming aid sold by Union Carbide Corporation, about one ounce of a wetting agent, such as a nonionic alkyl phenoxy polyoxyethylene ethanol, and about two hundred ninety five pounds of water. The combination of ingredients may be extruded using an extruding machine, such as one sold by Plymouth Locomotive Works, Inc., Plymouth, Ohio, into a hollow log-like shape to form an article in accordance with the invention, as illustrated, for example, in the several drawing figures hereof. The article may be dipped in hot wax to impregnate the same with wax to about two to about six percent by weight of the completed article.

As was mentioned briefly above, in the past to burn coal, a relatively controlled environment, for example having a strong draft with an abundant oxygen supply and a high temperature, was necessary. However, in accordance with the present invention, the tube-like restructured coal article artificially creates a satisfactory environment that enables burning in an otherwise relatively hostile fireplace or the like. The hollow core when not blocked permits the flow of air therethrough and the emission of methane-containing gas directly therein from the coal, thus allowing burning to occur both at the interior surface 8 of the wall 4 as well as the outer surface 9 thereof. The holes 6 and slots 7 also allow for air flow to permeate the article 1 and provide increased surface area portions thereof for the emission of such gas and its burning. Thus, after the article 1 has been ignited, for example, by a flame from a torch-like device, such as a match, a wick, igniter material, paper, cardboard, wood, etc., the heat generated by the burning and the relatively large amount of exposed surface area, e.g. the inner and outer surfaces of wall 4, holes 6 and slots 7, provide a good supply of oxygen-containing air close to the article 1 and the emission of gas therefrom for combustion with the air to produce a flame. While such combustion is occurring, the carbon in the coal article 1 also is being burned, and the ultimate residue produced at the conclusion of the combustion is a relatively fine powdery ash.

The slots 7 also effect a weakening of the tube-like article 1 to facilitate breaking the same, for example with a poker, after any flame has died down. By breaking the article 1 into several sections, then, additional fresh unburned surface area portions become exposed to provide for the emission of additional gas therefrom with subsequent combustion of such gas to produce more flame.

Figure 2:
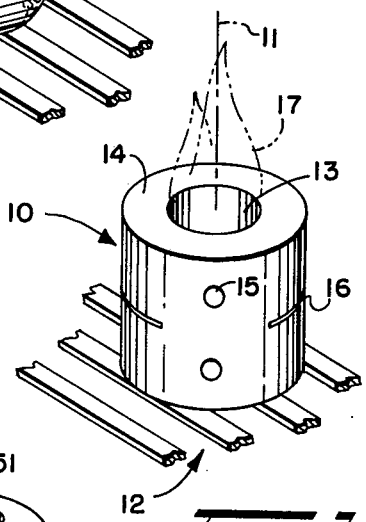
FIG. 2 is an isometric view of a similar vertically oriented coal article.

The restructured coal article 1 of FIG. 1 may be on the order of about 14 to about 20 inches long, which ordinarily is a suitable size to fit within the grate support 5. However, as is illustrated in FIG. 2, a restructured coal article 10 that is intended to be burned while positioned in a generally vertical orientation of its axis 11 has a somewhat shorter axial length, say, for example, on the order of about 4 to about 6 inches in order to fit vertically on grate 12 within standard fireplace clearance. The article 10 of FIG. 2 is otherwise similar to the article 1 described above with reference to FIG. 1 in terms of its size, formation, ingredients, and the like. The article 10 is tube-like, having a hollow core interior 13 within the generally cylindrical or similar shape wall 14, and holes 15 and slots 16 may be formed in the wall 14 as described above. After the article 10 has been ignited, for example using a torch-like igniter preferably to ignite the material thereof facing onto the core 13, the article 10 burns in a manner similar to a candle producing a candle-like flame 17 above the core. The flame 17 also reaches into the core 13 through which a stack effect is created drawing oxygen through the bottom of the article 10 for combustion of the gases and carbon about the hollow interior. Moreover, oxygen may be drawn through the openings 15 and slots 16 or, alternatively, flame may escape therefrom so that the article 10 becomes somewhat enveloped in flame. By burning the article 10 in such vertical orientation, the article itself creates its own stack, thus artificially creating the temperature and oxygen requirements necessary for good combustion of the coal as it burns from its hollow interior 13 to the outer surface of the wall 14. The major direction of the air flow and flame from the article 10 will be vertical, thus avoiding the flinging of sparks or hot cinders or embers away from the grate 12 out of the fireplace, for example.

Thus, it will be appreciated that in accordance with one method of the present invention a tube-like restructured coal article is placed in a generally vertical orientation to burn the same while it creates its own internal stack effect to continually support combustion thereof.

Figure 3:
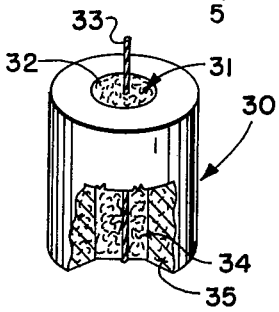
FIG. 3 is an isometric view partially broken away in section of a coal article with igniter material in the hollow core thereof.

Turning now to FIG. 3, a tube-like restructured coal article 30 has in its hollow interior core 31 a quantity of conventional igniter material 32. Such material 32 may include, for example, wax, sawdust, or other relatively easily burnable material that may be ignited via a fuse 33. The burning igniter material would ignite the article 30 along the inner surface 34 of the cylindrical wall 35 thereof. The igniter material 32 may partially or completely fill the hollow interior 31, as desired, so long as sufficient heat is produced thereby to ignite the coal in the article 30. Although not illustrated in the other Figures of this application, it will be appreciated that the igniter material 32 may be used in the hollow core of each of the tube-like restructured coal articles illustrated in the drawing and described herein to facilitate igniting the same.

Figure 4:
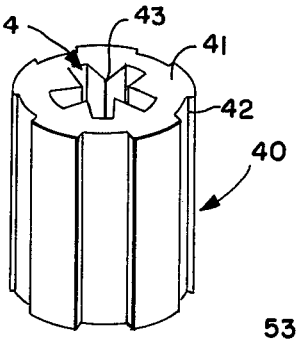
FIGS. 4, 5 and 6 are isometric views of modified embodiments of the coal article in accordance with the invention.

In the tube-like restructured coal article 40 of FIG. 4 the tube-like wall 41 has recessed trapezoidal shape flutes 42 in the exterior surface thereof. Moreover, interior rib-like projections 43 extend from the inner surface of the wall 41 toward the center of the hollow core 44. The flutes 42 and ribs 43 preferably are generally parallel to the axis 45 of the article 40 and one of their functions is to increase the surface area of the wall 41 that is exposed directly to an oxygen supply of the ambient environment and to increase the surface area from which gas is emitted from the article 40. The sharp corners or edges, particularly of the ribs 43, also facilitate igniting the article 40 at the inner surface of the wall 41 bounding the core 44 since such edges provide a relatively large exposure of surface area for the relatively small mass of material forming the same, thus allowing rapid heating and burning thereof. The article 40 may be formed of the ingredients and by the extrusion technique described above and may be burned as above.

Figure 5:
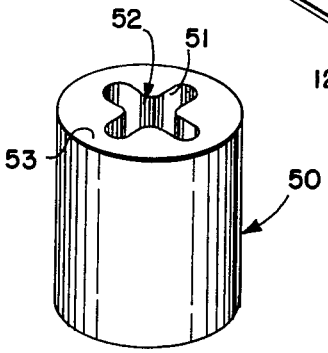

Referring to FIG. 5, a tube-like restructured coal article 50 similar to those described above has a smooth surface boundary 51 bounding the hollow core interior 52 thereof. Such smooth boundary has numerous curves in it to increase the surface area exposure, facilitating ignition and burning, as described above with reference to FIG. 4. However, the smooth curvature of the interior surface of the wall 53 reduces any crumbling or breaking off of part of the sharp edges of the ribs 43 in the above described article 40.

Figure 6:
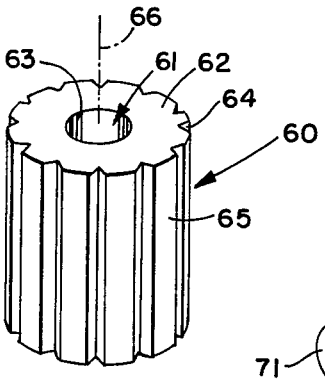

A modified tube-like restructured coal article 60 in FIG. 6 has a hollow interior core 61 circumscribed by the cylindrical wall 62. The inner surface 63 of the wall 62 is relatively smooth, e.g. having a circular cross section, although it could be ribbed or fluted as above, but a plurality of V-shape flutes 64 in the outer surface 65 of the wall 62 extend parallel with the axis 66 of the article 60 to increase the surface area exposure as described above.

Each of the above described tube-like restructured coal articles may be of approximately the same dimensions and formed by similar techniques. Moreover, each may include igniter material and/or a wick to facilitate igniting the same and, if desired, each may include holes, slots, or the like through the tube-like wall thereof. Also, each article may be burned in a horizontal, vertical, or in between orientation with the benefits of each being apparent from the above description. During such burning, both the methane-containing gas and the carbon of the article as well as other ingredients thereof ordinarily would be burned. The amount of heat emitted during such burning ordinarily would depend on the BTU value of the coal and/or other ingredients of the respective restructured coal articles and may be varied in conventional manner in dependence on the chemistry composition thereof.

Figure 7:
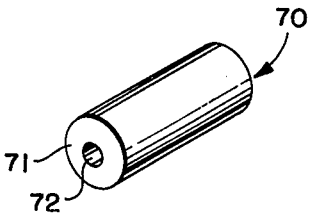
FIG. 7 is an isometric view of a pellet-like coal article.

A pellet size tube-like restructured coal article 70 is shown in FIG. 7 Such pellet 70 has a tube-like wall 71 bounding a hollow interior core 72. The pellet 70 may be formed of particulate coal and binder material that is extruded in the above described manner but on a smaller diameter scale. The axial length of the pellet 70 may be on the order of about 2 inches and the diameter may be on the order of about 1 inch. The diameter of the core 72 may be on the order of about ¼ inch. The relatively small size pellet may be easily burned due to its small size and mass but relatively large surface area exposure of the wall 71 about its outer circumference and its inner circumference bounding the core 72.

Figure 8:
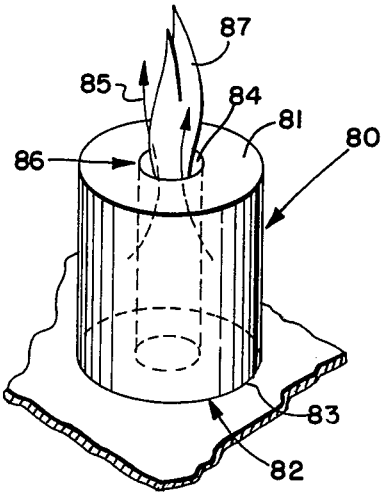
FIG. 8 is an isometric view of a coal article being burned in accordance with one method of the invention.

In accordance with the present invention a new method for burning coal is provided. This method is described with reference to FIG. 8 in which there is illustrated a tube-like restructured coal article 80 similar to those described above but having a generally imperforate tubular wall 81, i.e. preferably without the above described holes, slots or the like. The bottom 82 of the wall 81 is of a shape, for example flat, that mates with a support 83 which cooperates with the bottom 82 to block the flow of air into the hollow interior core 84. Igniter material, not shown, may be located in the core 84 to ignite the coal directly bounding the same or, alternatively, a torch flame may be used to ignite the coal along the core 84. If desired, the article 80 may be lifted from the surface 83 to allow oxygen to flow through the core 84 to support the initial combustion. After such initial combustion, though, the article 80 would be placed on the surface 83 in order to block any substantial flow of air through the core 84. However, the initial combustion ordinarily would produce sufficient heat to cause the coal proximate the core 84 to emit the methane-containing gas as shown by arrows 85, and this gas would continue to burn at the top 86 of the article 80 to produce a candle-like flame 87 outside and possibly just inside the core top where there is a source of ambient oxygen. The heat produced by such combustion will cause additional gas to be emitted by the coal with such gas tending to migrate from within the wall 81 toward the relatively hot central core area, the exterior surface of the wall 81 being relatively cooler, and then up to the flame for combustion thereat. During such combustion the free carbon of the coal article 80 is not consumed for there is insufficient oxygen available in the core to support such burning; rather, it is the gas that is burned ultimately leaving as a residue a tube-like article of substantially pure carbon or coke which may be easily disposed or subsequently used where a supply of carbon is required. It will be appreciated that the smooth, sharp, or other configuration ribs, flutes or the like described above may be employed in the article 80 to facilitate starting of ignition and the continued emission of gas into the core 84.

In view of the foregoing it will be appreciated that the restructured coal article of tube-like formation provides a use for particulate coal, such as coal fines, enables the burning of coal in a relatively uncontrolled or hostile environment, and provides a convenient method for effecting coking.

The embodiments of the invention in which an exclusive property or privilege is claimed are as follows:

1. A restructured coal article comprising a tube-like formation of coal, said tube-like formation of coal having a hollow core and relatively easily burnable igniter material at least substantially filling said core, said igniter material being capable of producing sufficient heat to ignite the article substantially completely along the inner surface of the wall circumscribing said hollow core.

2. A restructured coal article comprising a cylindrical tube-like formation of coal having a generally flat bottom end capable of supporting the article on a flat support in a vertically extending direction for combustion thereof.

3. A restructured coal article comprising a tube-like formation of coal having an axis, a hollow core and opening means in said formation extending radially relative to such axis through from said core to the outer surface of the article for enabling air flow to enter said core and for increasing the surface area from which volatile gases may issue from the article thereby to facilitate obtaining burning over substantially the entire length of the article.

4. A restructured coal article comprising a substantially completely integral tube-like formation of coal including means for facilitating the breaking of the same into several generally like pieces.

5. A restructured coal article comprising a tube-like formation of coal, the outer surface of said tube-like formation of coal being generally cylindrical and the interior surface of said tube-like formation of coal having rib-like protrusions in the same, each of said protrusions having a sharp edge extending longitudinally along the length of the article and the inner wall of the article circumscribing said hollow core including circumferential portions separating respective adjacent protrusions along the longitudinal extent of the article.

6. A restructured coal article comprising a tube-like formation of coal, the outer surface of said tube-like formation of coal being generally cylindrical and the interior surface of said tube-like formation of coal having rib-like protrusions in the same, each of said protrusions having a generally curved configuration for minimizing breakage thereof.

7. The article of claim 4, said means for facilitating comprising a plurality of slots extending radially and partially circumferentially in the article.

8. The article of claim 6, wherein said tube-like formation of coal is generally elongate and has a linear axis.

9. The article of claim 5, wherein said tube-like formation of coal is generally elongate and has a linear axis.

10. The article of claim 3, wherein said opening means comprise a plurality of holes.

11. the article of claim 3, wherein said opening means comprise a plurality of elongate slots.

12. The article of claim 1, further comprising a fuse extending out of said igniter material to facilitate igniting the latter.

* * * * *